US006999034B1

(12) United States Patent
Tsai et al.

(10) Patent No.: US 6,999,034 B1
(45) Date of Patent: Feb. 14, 2006

(54) WIDE RECEIVING RANGE ANTENNA

(75) Inventors: Churng-Jou Tsai, Taipei (TW); Woody Huang, Taipei (TW)

(73) Assignees: Antenniques Corp. Ltd., Taipei Hsien (TW); Runtop Inc., Taoyuan (TW)

( * ) Notice: Subject to any disclaimer, the term of this patent is extended or adjusted under 35 U.S.C. 154(b) by 0 days.

(21) Appl. No.: 10/711,217

(22) Filed: Sep. 2, 2004

(51) Int. Cl.
*H01Q 1/32* (2006.01)

(52) U.S. Cl. ..... 343/715; 343/882; 343/900; 343/901

(58) Field of Classification Search ..... 343/702, 343/715, 882, 900, 901
See application file for complete search history.

(56) References Cited

U.S. PATENT DOCUMENTS 6,597,326 B1 * 7/2003 Chen ..... 343/895
6,608,597 B1 * 8/2003 Hadzoglou et al. ..... 343/713
6,639,562 B1 * 10/2003 Suganthan et al. ..... 343/702
6,642,899 B1 * 11/2003 Strickland et al. ..... 343/773
6,703,987 B1 * 3/2004 Yabuki ..... 343/895
6,788,261 B1 * 9/2004 Buren ..... 343/715
6,828,944 B1 * 12/2004 Martiskainen et al. ..... 343/792
6,853,340 B1 * 2/2005 Wang ..... 343/715

* cited by examiner

*Primary Examiner*—Tan Ho

(57) ABSTRACT

A wide receiving range antenna is disclosed to include a holder base, and a resonator unit connected to one end of the holder base for receiving signal, which the resonator unit having a barrel connected to the holder base, a metal block spaced from the barrel at a predetermined distance and connected to a coaxial cable being inserted through the holder base, and a plurality of resonators axially extended from one side of the metal block opposite to the coaxial cable for receiving signals of different frequencies and transmitting received signals to an electronic device through the coaxial cable.

11 Claims, 7 Drawing Sheets

WIDE RECEIVING RANGE ANTENNA

BACKGROUND OF THE INVENTION

1. Field of the Invention

The present invention relates to an antenna and more particularly, to a wide receiving range antenna, which comprises a plurality of tubular resonators of different diameters for receiving signals of different frequencies.

2. Description of the Related Art

Following population of the Internet, fast development of communication and single-chip system technology, and diversification of communication service content, diversified high-tech products have been continuously developed and appeared on the market. It is the market tendency toward the realization of light, thin, short and small products with reliable and long life. In early time, an antenna was designed for receiving wireless signal of a specific frequency. Therefore, different antennas were necessary for receiving signals of different frequencies. In order to save the cost, multi-frequency antennas are developed. FIG. 8 shows a multi-frequency antenna according to the prior art. According to this design, the multi-frequency antenna comprises a holder base A, a coaxial cable A1 fastened to the holder base A, and a metal wire conductor B connected to the coaxial cable A1. The metal wire conductor B comprises a first coil portion B1 and a second coil portion B2 connected in series for receiving signals of different frequencies. This design of multi-frequency antenna has drawbacks. Because the metal wire conductor B has a first coil portion B1 and a second coil portion B2 connected in series, the antenna requires much installation space in an electronic device (for example, wireless exchanger or wireless network card). Because this design of multi-frequency antenna requires much installation space, it does not meet the technology necessary for the realization of light, thin, short and small products with reliable and long life. Further, it is complicated to process the first coil portion B1 and the second coil portion B2 subject to designed specifications, and the metal wire conductor B of the multi-frequency antenna may be deformed or damaged easily during delivery.

In order to eliminate the aforesaid drawbacks, a dual-frequency antenna is disclosed using two spaced hollow tubes to produce a high frequency signal resonance during a low frequency signal resonance. However, the performance of this design of dual-frequency antenna is still not perfect during a high frequency application.

SUMMARY OF THE INVENTION

The present invention has been accomplished under the circumstances in view. It is therefore the main object of the present invention to provide a wide receiving range antenna, which enhances signal stability and requires less installation space. It is still another object of the present invention to provide a wide receiving range antenna, which meets the technology necessary for the realization of light, thin, short and small products with reliable and long life.

To achieve these and other objects of the present invention, the wide range receiving antenna comprises a holder base, a resonator unit connected to one end of the holder base for receiving signal, and a coaxial cable inserted through the holder base and connected to the resonator unit, wherein the resonator unit is made of metal, comprising a barrel, the barrel having a first end connected to the holder base and a second end, a metal block spaced from the second end of the barrel at a predetermined distance, the metal block having a first side facing the barrel and connected to the coaxial cable and a second side, and a plurality of resonators axially extended from the second side of the metal block adapted to receive signals of different frequencies and transmitting received signals to an electronic device through the coaxial cable. Further, the resonators are respectively made of copper tubes of different diameters. According to one embodiment, the resonators are arranged in parallel to minimize the total length of the antenna. Alternatively the resonators can axially be connected in a line.

BRIEF DESCRIPTION OF THE INVENTION

DETAILED DESCRIPTION OF THE PREFERRED EMBODIMENT

Figure 1:
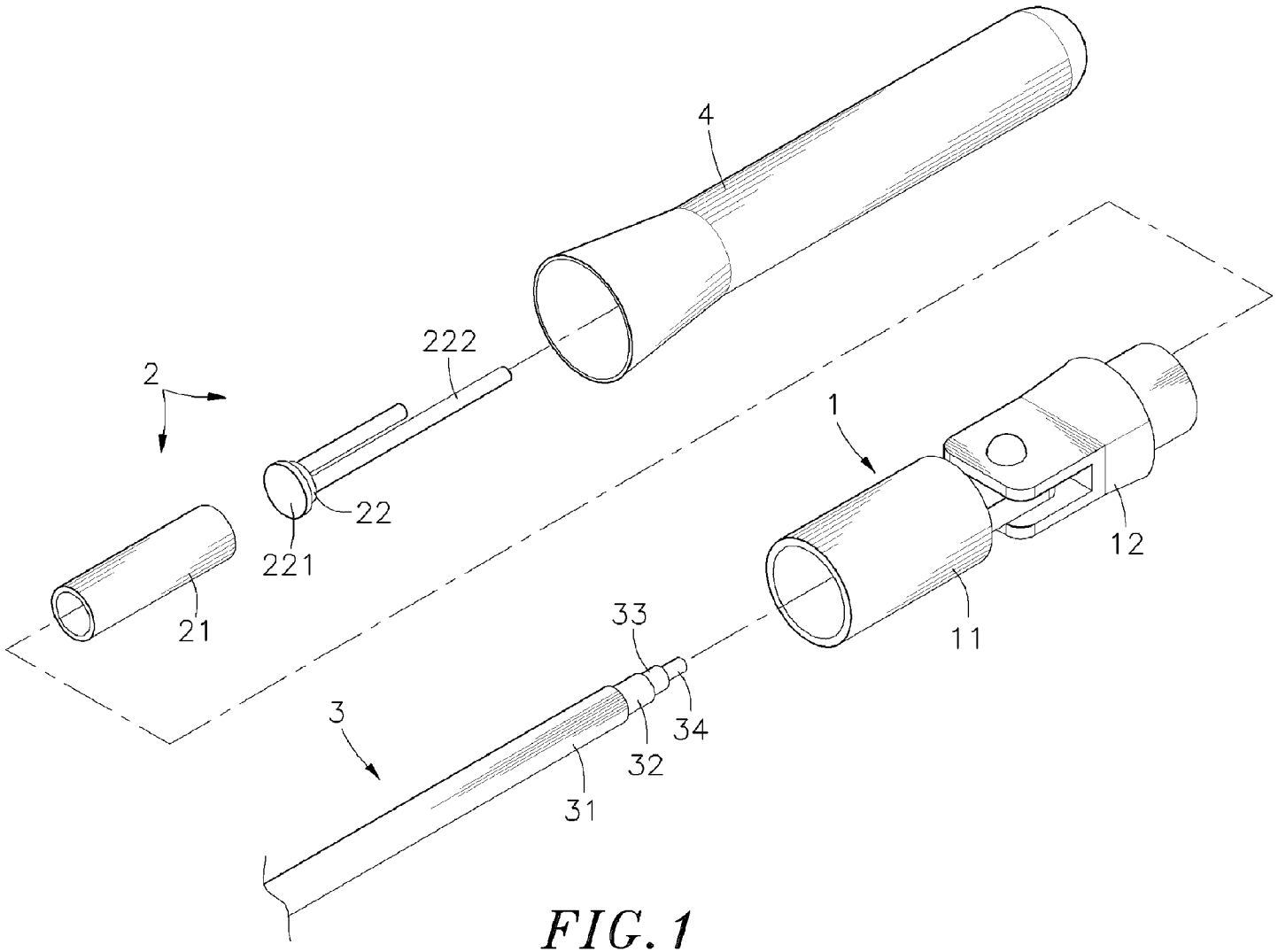
FIG. 1 is an exploded view of a wide receiving range antenna according to the present invention.

Referring to FIG. 1, a wide receiving range antenna in accordance with the present invention is shown comprised of a holder base 1, a resonator unit 2, a coaxial cable 3, and a shell 4.

The holder base 1 comprises a holder 11 and a swivel connector 12 pivotally coupled to the holder 11.

The resonator unit 2 is made of metal, comprising a barrel 21, a metal block 22 spaced from one end of the barrel 21 at a distance, the metal block 22 having connecting face 221 facing the barrel 21, and a plurality of resonators 222 axially extended from one side of the metal block 22 opposite to the connecting face 221.

The coaxial cable 3 comprises an inner insulator 33, and a central conductor 34 held in the inner insulator 33, a tube of conducting material 32 surrounding the inner insulator 33 and the central conductor 34, and an outer insulator 31 covering the tube of conducting material 32.

The shell 4 is a hollow cylindrical member made of electrically insulative material.

Figure 2:
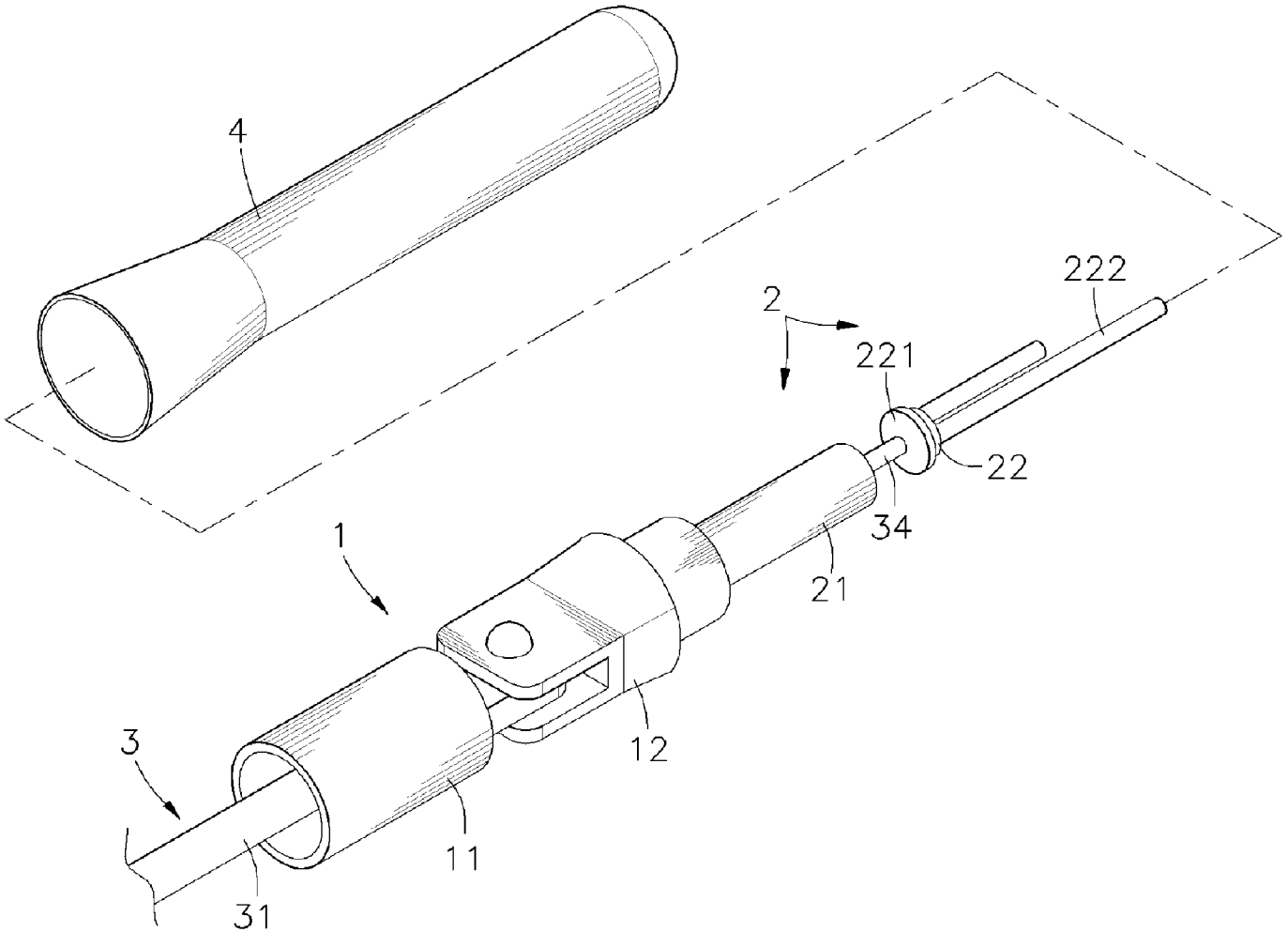
FIG. 2 is an assembly view of the wide receiving range antenna according to the present invention before connection of the shell.
Figure 3:
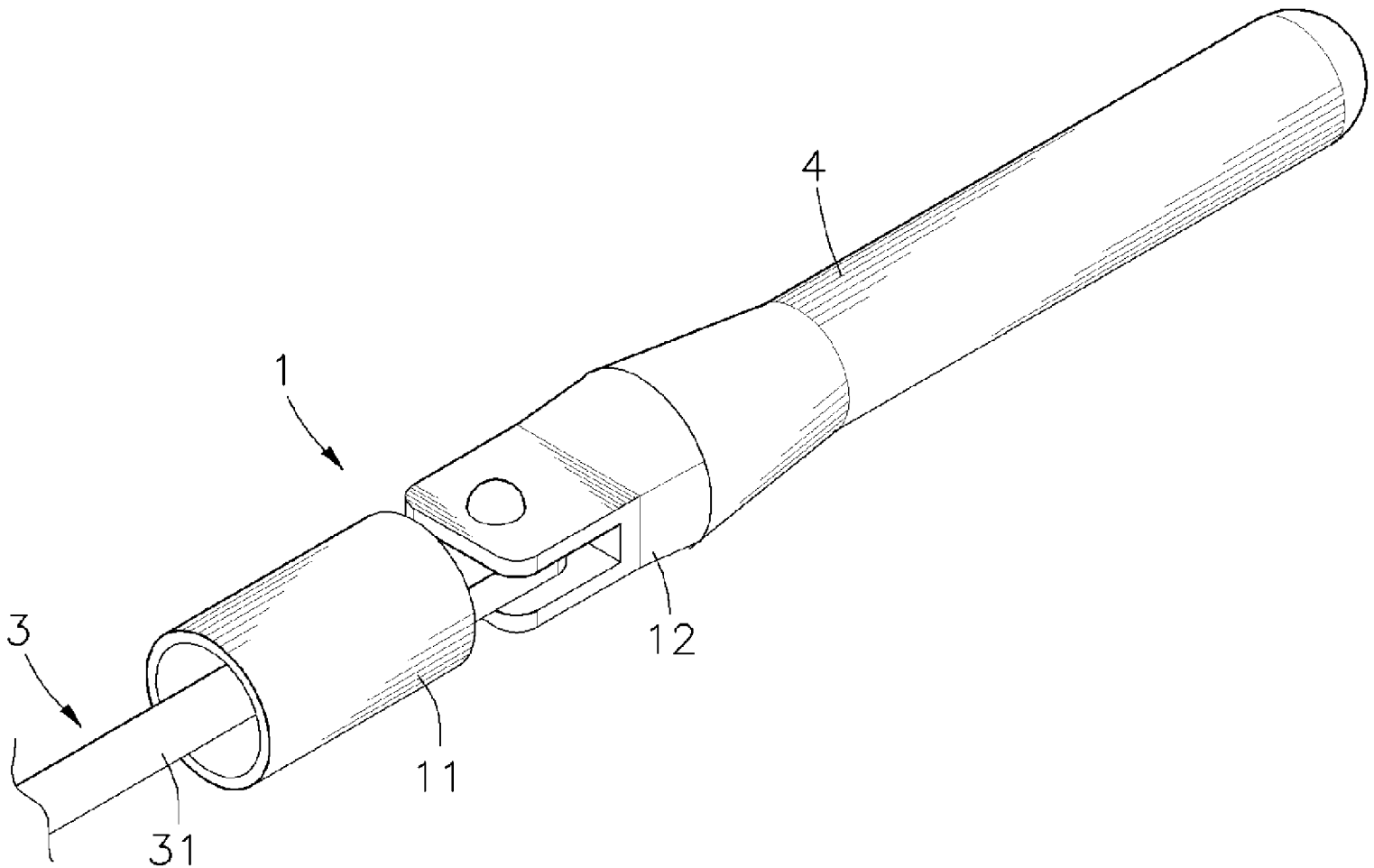
FIG. 3 is an assembly view of the wide receiving range antenna according to the present invention after connection of the shell.

Referring to FIGS. 2 and 3 and FIG. 1 again, the barrel 21 of the resonator unit 2 is fastened to the swivel connector 12 of the holder base 1, and then the coaxial cable 3 is inserted in proper order through the holder 11, the swivel connector 12 and the barrel 21 to have the central conductor 34 connected to the connecting face 221 of the metal block 22 and the tube of conducting material 32 connected to the barrel 21, and then the shell 4 is capped on the resonator unit 2 and affixed to the swivel connector 12 of the holder base 1.

Figure 4:
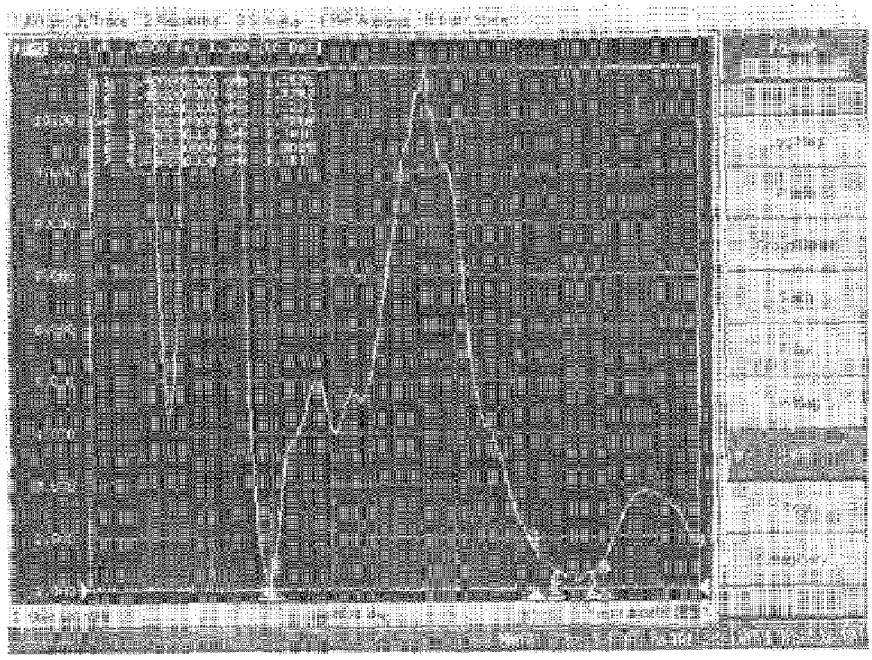
FIG. 4 is a standing wave ratio chart obtained from the wide receiving range antenna according to the present invention.
Figure 5:
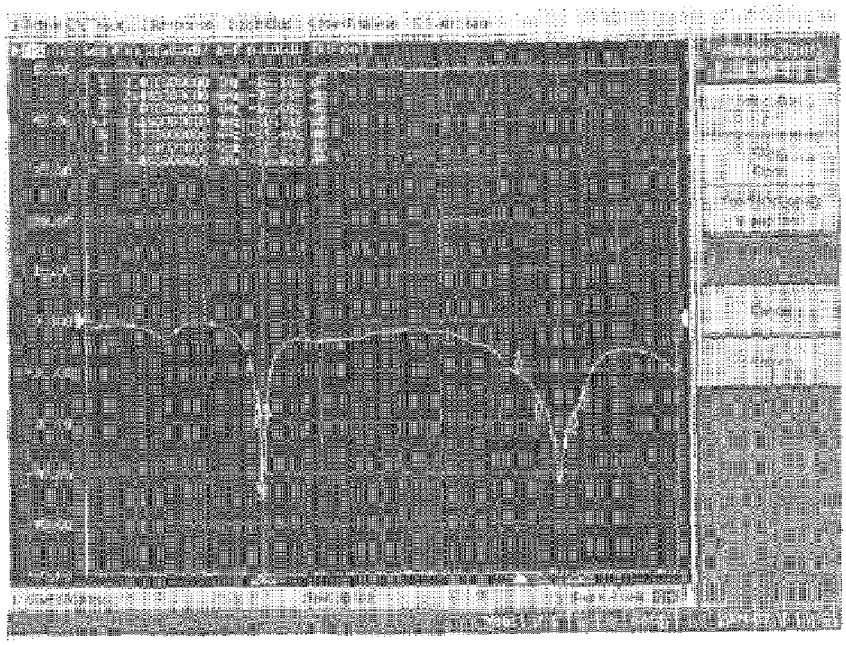
FIG. 5 is a feedback loss chart obtained from the wide receiving range antenna according to the present invention.

Referring to FIGS. 4 and 5 and FIG. 1 again, by means of the barrel 21 and the resonators 222, the resonator unit 2 is capable of producing a low-frequency resonance. Further, because the metal block 22 is spaced from the barrel 21 at a fixed distance, a high-frequency resonance is produced at the same time, and the standing wave ratio and feedback loss are respectively maintained below a respective predetermined value to obtain a stable signal transmitted to an electronic device through the coaxial cable 3. The shell 4 that is covered on the resonator unit 2 effectively amplifies the bandwidth of the low frequency band and the high frequency band.

Further, the distance between the metal block 22 and the barrel 21 is preferably set between $\frac{1}{12}\lambda \sim \frac{1}{25}\lambda$ of the center carrier of high frequency band for high frequency application.

Figure 6:
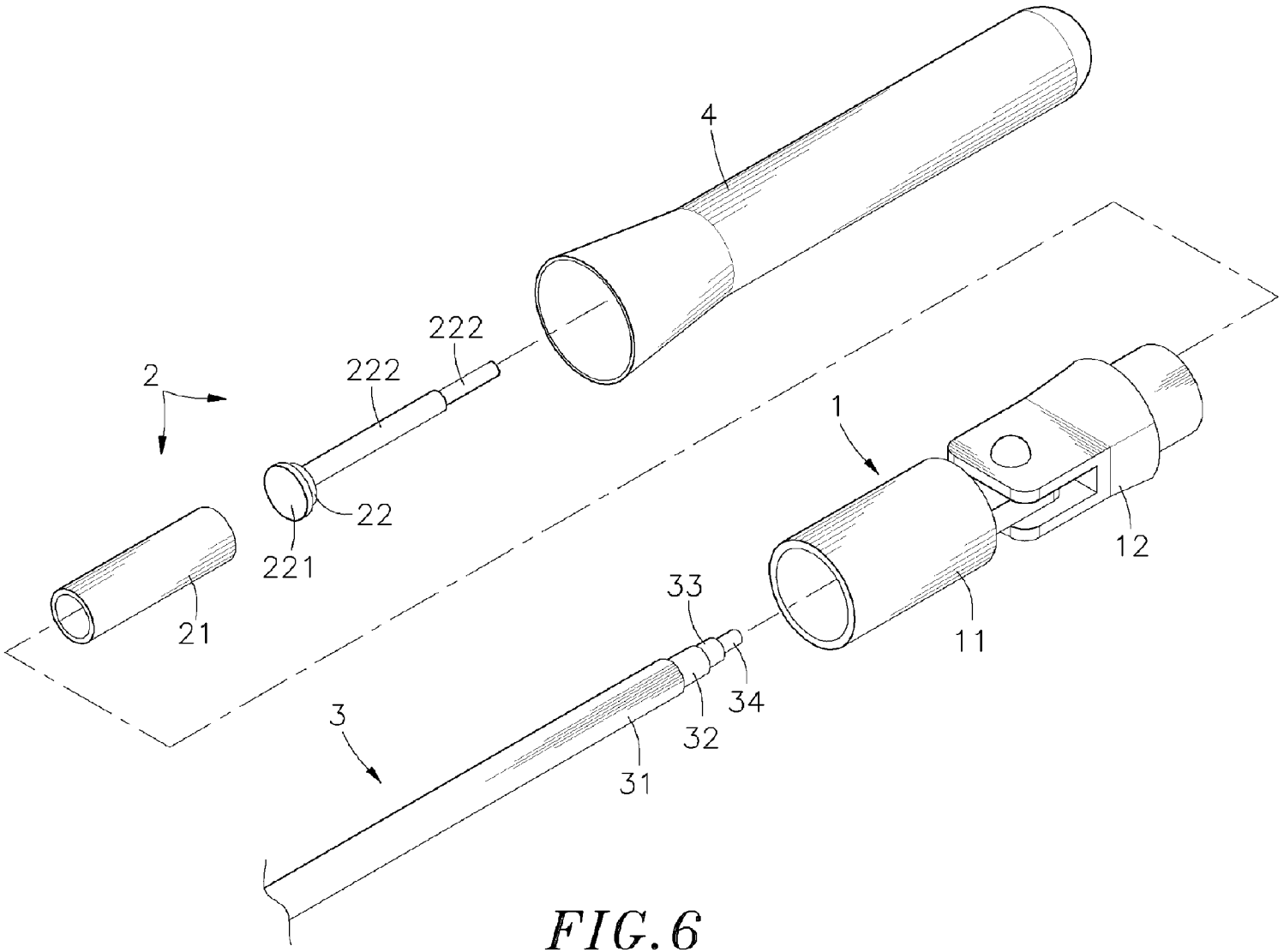
FIG. 6 is an exploded view of an alternate form of the wide receiving range antenna according to the present invention.

In the embodiment shown in FIGS. 1~3, the resonators 222 are arranged in parallel. FIG. 6 shows an alternate form of the present invention. According to this embodiment, the resonators 222 have different outer diameters and axially connected in a line. Preferably, the resonators 222 are respectively made of copper tubes.

Figure 7:
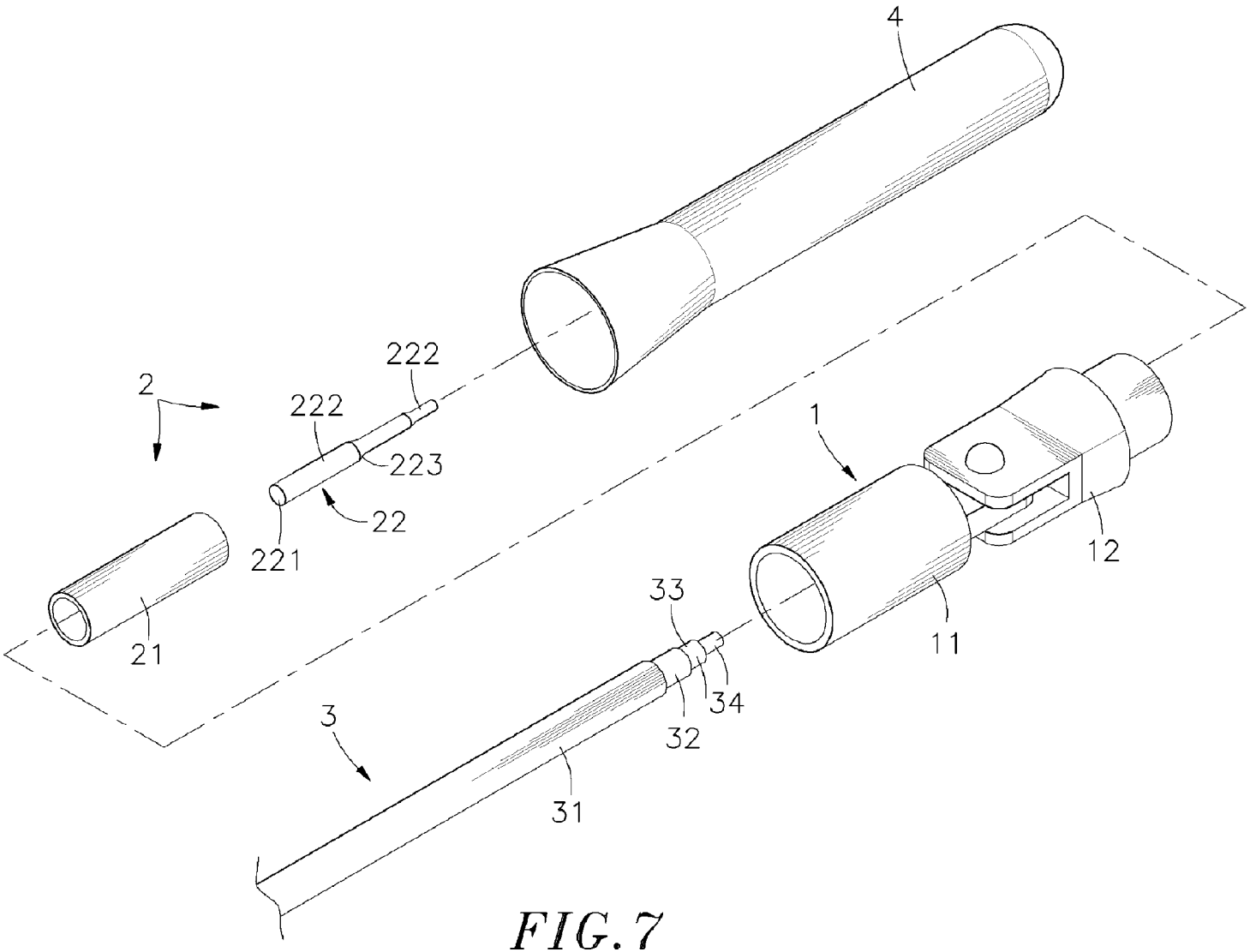
FIG. 7 is an exploded view of another alternate form of the wide receiving range antenna according to the present invention.
Figure 8:
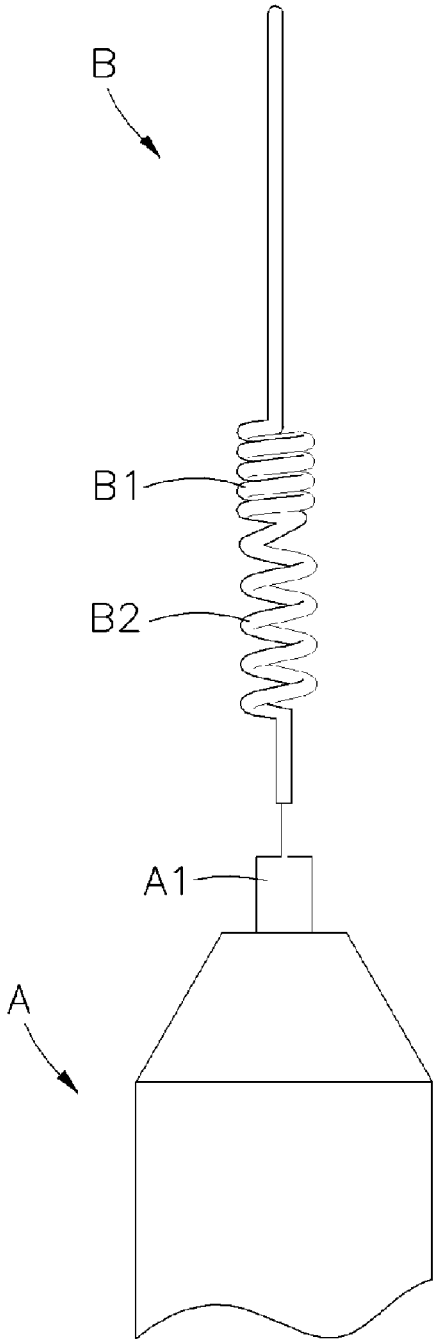
PRIOR ART FIG.8
FIG. 8 is a side view of an antenna according to the prior art.

FIG. 7 shows another alternate form of the present invention. According to this embodiment, the resonators 222 are axially connected in a line and formed integral with the metal block 22, and a sloping surface portion 223 is provided between each two adjacent resonators 222 to reduce skin effect during signal transmission, enhancing signal stability.

As indicated above, the arrangement of the resonators 222 at the metal block 22 effectively minimizes the total length of the antenna and enhances signal stability, enabling the antenna to receive different bandwidth signals. Further, the swivel connector 12 of the holder base 1 allows the user to adjust the azimuth of the antenna conveniently; the shell 4 well protects the resonator unit 2 and increases the bandwidth, preventing deformation of the resonator unit 2 upon a vibration or impact.

A prototype of wide receiving range antenna has been constructed with the features of FIGS. 1~7. The wide receiving range antenna functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A wide receiving range antenna comprising a holder base, a resonator unit connected to one end of said holder base for receiving signal, and a coaxial cable inserted through said holder base and connected to said resonator unit, wherein said resonator unit is made of metal, comprising a barrel, said barrel having a first end connected to said holder base and a second end, a metal block spaced from the second end of said barrel at a predetermined distance, said metal block having a first side facing said barrel and connected to said coaxial cable and a second side, and a plurality of resonators axially extended from the second side of said metal block adapted to receive signals of different frequencies and transmitting received signals to an electronic device through said coaxial cable.

2. The wide receiving range antenna as claimed in claim 1, wherein said resonators are arranged in parallel.

3. The wide receiving range antenna as claimed in claim 2, wherein said barrel and said resonators are respectively made of copper.

4. The wide receiving range antenna as claimed in claim 1, wherein said resonators are tubular members of different diameters axially connected in a line.

5. The wide receiving range antenna as claimed in claim 2, wherein said barrel and said resonators are respectively made of copper.

6. The wide receiving range antenna as claimed in claim 1, wherein said resonators are formed integral with said metal block, each having a sloping surface portion respectively connected to the adjacent resonator.

7. The wide receiving range antenna as claimed in claim 6, wherein said barrel and said resonators are respectively made of copper.

8. The wide receiving range antenna as claimed in claim 1, wherein said barrel and said resonators are respectively made of copper.

9. The wide receiving range antenna as claimed in claim 1, wherein said holder base comprises a holder and a swivel connector pivotally coupled to said holder and adapted to receive said barrel.

10. The wide receiving range antenna as claimed in claim 1, wherein said resonator unit is covered by a shell made of electrically insulative material.

11. The wide receiving range antenna as claimed in claim 1, wherein the distance between said barrel and said metal block is set within $\frac{1}{12}\lambda \sim \frac{1}{25}\lambda$ of the center carrier of high frequency band for high frequency application.

* * * * *